US009602927B2

(12) United States Patent
Lau

(10) Patent No.: US 9,602,927 B2
(45) Date of Patent: Mar. 21, 2017

(54) SPEAKER AND ROOM VIRTUALIZATION USING HEADPHONES

(71) Applicant: Conexant Systems, Inc., Newport Beach, CA (US)

(72) Inventor: Harry K. Lau, Norwalk, CA (US)

(73) Assignee: Conexant Systems, Inc., Irvine, CA (US)

( * ) Notice: Subject to any disclaimer, the term of this patent is extended or adjusted under 35 U.S.C. 154(b) by 236 days.

(21) Appl. No.: 13/765,007

(22) Filed: Feb. 12, 2013

(65) Prior Publication Data

US 2013/0216073 A1 Aug. 22, 2013

Related U.S. Application Data

(60) Provisional application No. 61/598,267, filed on Feb. 13, 2012.

(51) Int. Cl.

| | |
|---|---|
| ***H04R 5/033*** | (2006.01) |
| ***H04S 7/00*** | (2006.01) |
| *G10K 15/08* | (2006.01) |

(52) U.S. Cl.

CPC ..... *H04R 5/033* (2013.01); *H04S 7/30* (2013.01); *G10K 15/08* (2013.01); *H04S 2420/01* (2013.01)

(58) Field of Classification Search

CPC ..... H04R 5/033; H04S 7/30; H04S 2420/01; G10K 15/08

USPC ..... 84/737; 181/286, 287; 381/17, 27, 63, 381/103, 120, 176, 309, 351, 22, 23, 1; 367/118; 700/94; 704/500; 710/15

See application file for complete search history.

(56) References Cited

U.S. PATENT DOCUMENTS

| | | | | |
|---|---|---|---|---|
| 4,347,405 | A * | 8/1982 | Davis | 381/309 |
| 5,748,758 | A * | 5/1998 | Menasco, Jr. | 381/176 |
| 6,470,087 | B1 * | 10/2002 | Heo | 381/17 |
| 6,643,379 | B1 * | 11/2003 | Onglao | 381/351 |
| 6,931,134 | B1 * | 8/2005 | Waller et al. | 381/27 |
| 7,391,876 | B2 | 6/2008 | Cohen et al. | |
| 7,572,972 | B2 * | 8/2009 | Gustafsson | 84/737 |
| 7,600,608 | B2 * | 10/2009 | Freiheit | 181/287 |
| 7,604,094 | B2 * | 10/2009 | Magyari | 181/286 |
| 7,634,092 | B2 * | 12/2009 | McGrath | 381/17 |
| 7,936,887 | B2 | 5/2011 | Smyth | |
| 8,270,616 | B2 * | 9/2012 | Slamka | H04S 7/306 381/1 |
| 8,374,365 | B2 | 2/2013 | Goodwin et al. | |
| 8,553,895 | B2 * | 10/2013 | Plogsties | H04S 3/004 381/17 |
| 8,638,946 | B1 * | 1/2014 | Mahabub | 381/17 |
| 8,885,442 | B2 * | 11/2014 | Agevik | G01H 7/00 367/118 |
| 8,885,834 | B2 * | 11/2014 | Kuhr et al. | 381/17 |
| 8,908,875 | B2 * | 12/2014 | De Sena et al. | 381/63 |
| 8,965,000 | B2 * | 2/2015 | Engdegard | 381/63 |
| 2002/0039421 | A1 * | 4/2002 | Kirkeby | H04S 1/005 381/17 |
| 2005/0100171 | A1 * | 5/2005 | Reilly | G10H 1/0091 381/63 |

(Continued)

*Primary Examiner* — Gerald Gauthier
(74) *Attorney, Agent, or Firm* — Haynes & Boone, LLP

(57) ABSTRACT

A system for audio processing comprising a room reflection emulation system for emulating sound reflections in a room. A room acoustics emulation system for emulating acoustic properties of the room. A head, shoulder and ear emulation system for emulation sound reflections near the head.

20 Claims, 5 Drawing Sheets

(56) References Cited

U.S. PATENT DOCUMENTS

2005/0271214 A1* 12/2005 Kim ..... 381/17
2005/0276430 A1* 12/2005 He ..... H04S 3/004
381/309
2007/0213990 A1* 9/2007 Moon ..... H04S 3/008
704/500
2007/0223708 A1* 9/2007 Villemoes ..... H04S 3/004
381/17
2007/0223749 A1* 9/2007 Kim ..... G10L 19/008
381/309
2007/0280485 A1* 12/2007 Villemoes ..... G10L 19/008
381/22
2008/0008324 A1* 1/2008 Sim ..... H04S 5/00
381/1
2008/0025519 A1* 1/2008 Yu ..... H04S 3/002
381/17
2008/0037795 A1* 2/2008 Ko ..... H04S 3/002
381/17
2008/0168188 A1* 7/2008 Yue ..... G06F 9/445
710/15
2008/0226103 A1* 9/2008 Schobben ..... 381/309
2008/0273708 A1* 11/2008 Sandgren ..... G10K 15/08
381/63
2011/0046761 A1* 2/2011 Titchener ..... G11B 20/00007
700/94
2011/0200195 A1* 8/2011 Lau et al. ..... 381/17
2013/0163784 A1* 6/2013 Tracey et al. ..... 381/103
2013/0163787 A1* 6/2013 Moon ..... 381/120
2013/0216073 A1* 8/2013 Lau ..... 381/309
2015/0244869 A1* 8/2015 Cartwright ..... H04M 3/568
370/260

* cited by examiner

SPEAKER AND ROOM VIRTUALIZATION USING HEADPHONES

RELATED APPLICATIONS

The present application claims benefit of U.S. Provisional patent application 61/598,267, entitled "Speaker and Room Virtualization Using Headphones," filed Feb. 13, 2012, which is hereby incorporated by reference for all purposes.

TECHNICAL FIELD

The present disclosure relates generally to audio processing, and more specifically to speaker and room virtualization for audio signal that is to be provided to headphones.

BACKGROUND OF THE INVENTION

When a user listens to music with headphones, audio signals that are mixed to come from the left or right side sound to the user as if they are located adjacent to the left and right ears. Audio signals that are mixed to come from the center sound to the listener as if they are located in the middle of the listener's head. This placement effect is due to the recording process, which assumes that audio signals will be played through speakers that will create a natural dispersion of the reproduced audio signals within a room, where the room provides a sound path to both ears. Playing audio signals through headphones sounds unnatural because there is no sound path to both ears. Also, the lack of room reflections concentrates the audio signals in the listener's head.

SUMMARY OF THE INVENTION

In accordance with the present disclosure, a system for audio processing for headphones is disclosed. The system includes a room reflection emulation system for emulating sound reflections in a room, and a room acoustics emulation system for emulating acoustic properties of the room. A head, shoulder and ear emulation system for emulation sound reflections near the head is also provided.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
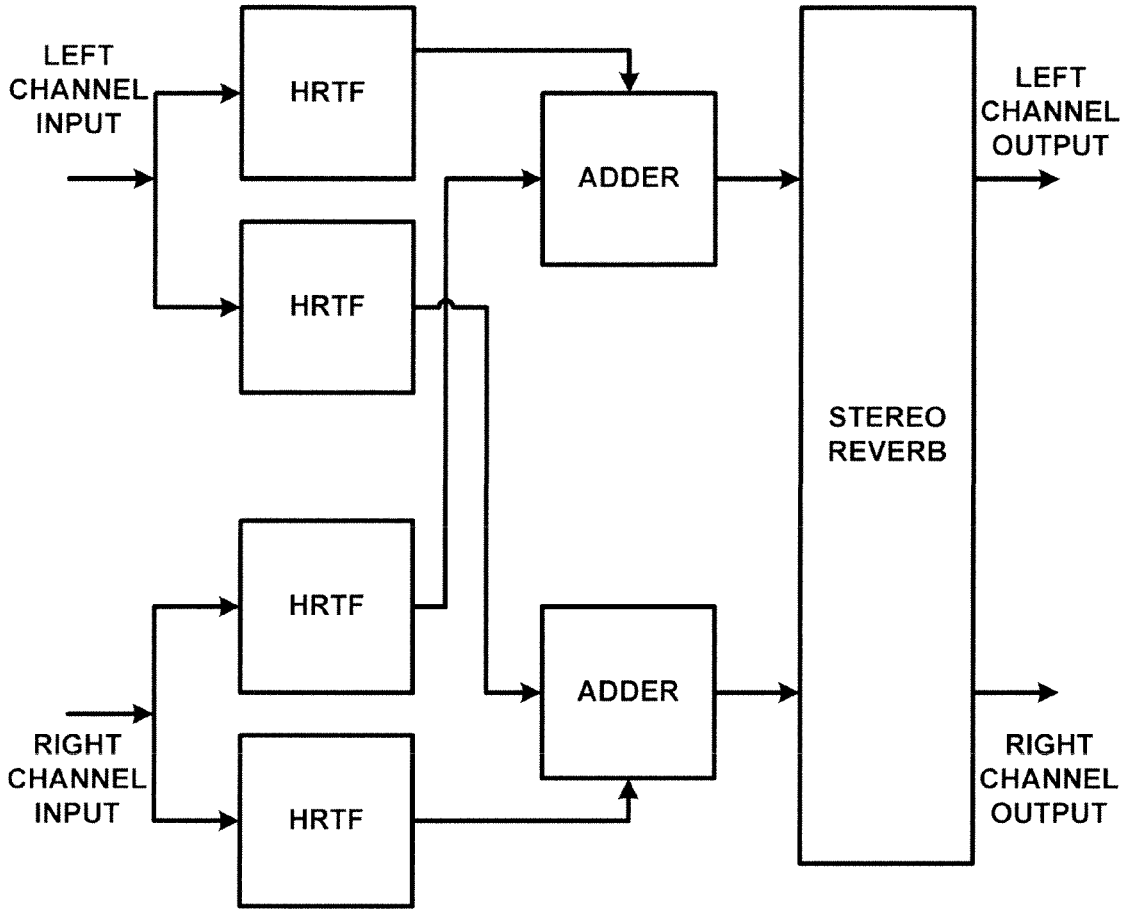
FIG. 1 is a diagram of a system in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

The present disclosure implements an algorithm that emulates speakers placed in a room for use with stereo headphones, to simulate the existence of sound paths to both ears, and also to add stereo reverberation for a realistic room effect. The location of the virtual speakers and the associated room size (which is reflected in the reverberation effect) are user selectable. This disclosure uses delay and cross-mixing of the left and right channel audio signals to the headphone speakers, but extensions to N-channel sound with additional audio signals (such as left front, left rear, right front and right rear) are also possible. The delay and mixing amplitude is based on a physical environment.

The present disclosure includes a tuned stereo reverb algorithm that emulates room reflections. There is very little coloration of the sound so it is basically unnoticeable.

Some previous simple reverb solutions cause metallic sound. The density of the disclosed reverb is high enough to not cause unnatural sound. Likewise, some previous reverb solutions use identical reverb on both sound channels, but such applications do not emulate the reflections that would normally be heard by a listener. In contrast, the disclosed system uses tuned non-identical reverb to generate a stereo room effect.

The disclosed cross-mixing, delay and reverb processing is efficiently configured so as to be within the processing capability of a general purpose processor, such as a personal computer or tablet computer, or of other embedded systems, such as those used in personal electronic devices, cellular telephones or other common devices.

The present disclosure can be used to emulate a room environment with virtual speakers for use with headphones. The user can select the angle to the center where the virtual speakers should be located. A head-related transfer function (HRTF) algorithm is applied to each audio channel so as to cause the sound to appear to the user to come from that angle. The user can also select the room size, which can be used by the reverb engine for intensity and duration of the reverberation effect.

FIG. 1 is a diagram of a system 100 in accordance with an exemplary embodiment of the present disclosure. System 100 can be implemented in hardware or a suitable combination of hardware and software.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

The first stage of system 100 includes HRTF emulation, which emulates sound reflections that would normally occur when the audio signals travel around the head to the ears, such as to model reflection of audio signals by the listener's shoulders. Each channel of audio pulse code modulated (PCM) signals passes through a pair of HRTF emulation engines. Each HRTF engine emulates the sound coming in as having a predetermined azimuth and elevation angle with respect to the user. The second stage of system 100 includes a stereo reverberation generator, which is discussed in greater detail herein.

Figure 2:
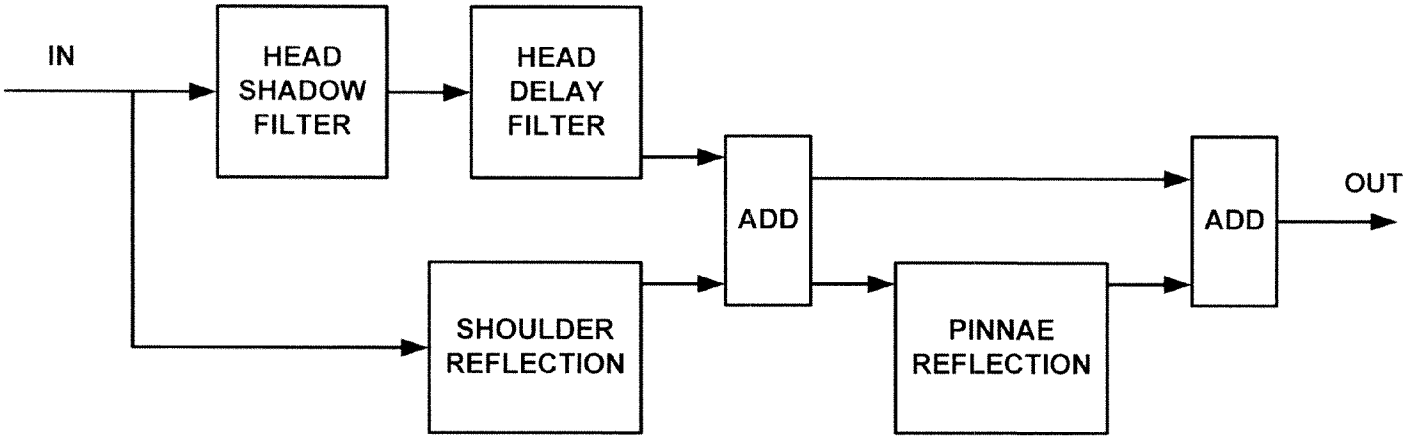
FIG. 2 is a diagram of an exemplary HRTF engine in accordance with an exemplary embodiment of the present disclosure.

FIG. 2 is a diagram of an exemplary HRTF engine in accordance with an exemplary embodiment of the present disclosure. The HRTF engine includes the following components:

1. Head shadow filter—the head shadow filter provides attenuation on higher frequency audio components when the source is within the shadow of the head, i.e., on the opposite side from the channel being processed.
2. Head delay filter—the head delay filter emulates the delay for sound to pass around head to the ear.
3. Shoulder reflection processor—the shoulder reflection processor emulates reflections when sound is reflected from shoulder to ear.
4. Pinnae reflection processor—the pinnae reflection processor emulates reflections that occur within the pinnae.

For the head shadow filter, the azimuth angle θ of sound is used to generate a variable α, where:

$$\alpha = 1.05 + 0.95\ \cos\left(\frac{\Theta}{150^\circ} * 180^\circ\right)$$

The transfer function of the 1-tap infinite impulse response (IIR) filter that emulates head shadowing can then be calculated by:

$$H_{hs} = \frac{(\omega_0 + \alpha F_s) + (\omega_0 - \alpha F_s)z^{-1}}{(\omega_0 + F_s) + (\omega_0 - F_s)z^{-1}}$$

where $\omega_O$=speed of sound/radius of head, and $F_S$=sampling rate

The head shadow filter can be implemented using this algorithm in conjunction with a first order IIR digital filter.

The head delay filter can be implemented using a first order all-pass digital filter. The group delay for the azimuth angle θ can be defined as:

$$\tau_h 0 = \begin{cases} -\frac{\alpha}{c}\cos, & 0 \le\ < \Pi/2 \\ \frac{\alpha}{c}\left(\|-\frac{\Pi}{2}\right), & \frac{\Pi}{2} \le \| < \Pi \end{cases}$$

$$a = \frac{1-\tau_h}{1+\tau_h}$$

$$H_{sh} = \frac{a + z^{-1}}{1 + az^{-1}}$$

Figure 4:
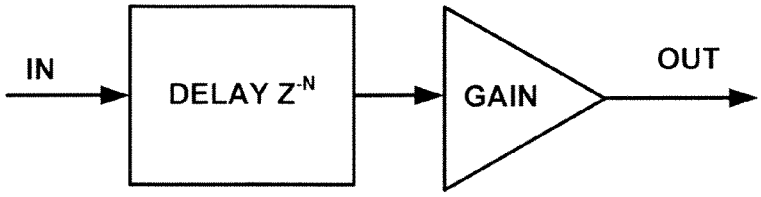
FIG. 4 is a diagram of an exemplary shoulder reflection generator in accordance with an exemplary embodiment of the present disclosure.

FIG. 4 is a diagram of an exemplary shoulder reflection generator in accordance with an exemplary embodiment of the present disclosure. The shoulder reflection generator can be implemented with a digital tap delay. An approximation of the time delay can be defined as:

$$\tau_{SH}(\Theta) = 1.2\frac{180-\Theta}{180}\left(1 - 0.00004((\phi - 80) * \frac{180}{180+\phi}\right)^2$$

where the gain can be defined as:

$$g_{sh}=\cos(+90)*0.15$$

Figure 5:
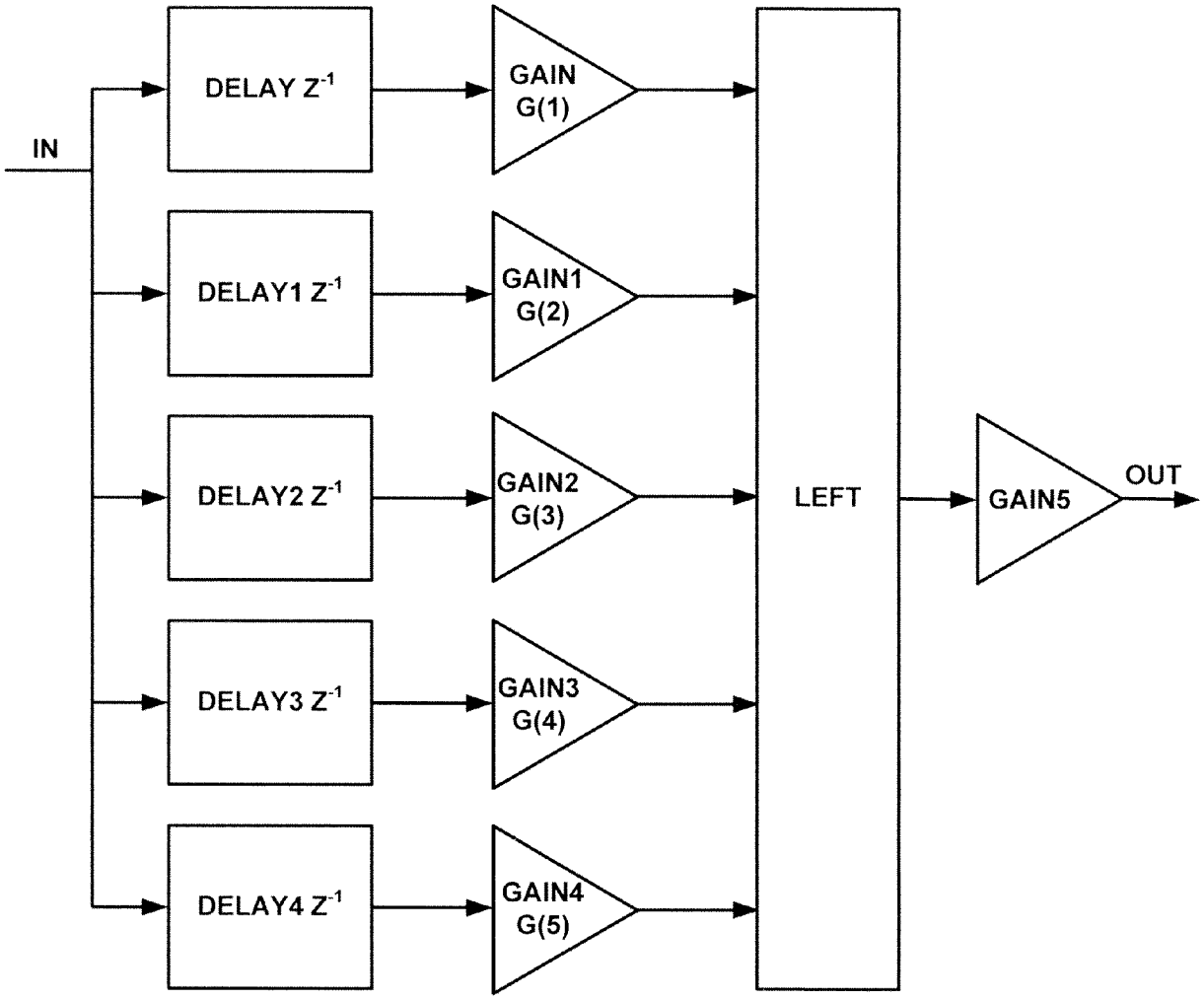
FIG. 5 is a diagram of an exemplary pinnae reflection generator in accordance with an exemplary embodiment of the present disclosure.

FIG. 5 is a diagram of a pinnae reflection generator in accordance with an exemplary embodiment of the present disclosure. The pinnae reflection generator can be implemented using 5 stages of a digital tap delay.

$$A_n=\{1,5,5,5,5\}$$

$$B_n=\{2,4,7,11,13\}$$

$$D_n=\{1,0.5,0.5,0.5,0.5\}$$

Delay can be defined as:

$$\tau_{pn} = A_n\cos\left(\frac{\Theta}{2}\right)\sin(D_n(90-\phi)) + B_n$$

where

ϕ is the elevation angle.

In one exemplary embodiment, the gain for the 5 stages can be G={0.5, −0.4, 0.5, −0.25, 0.25}

Figure 3:
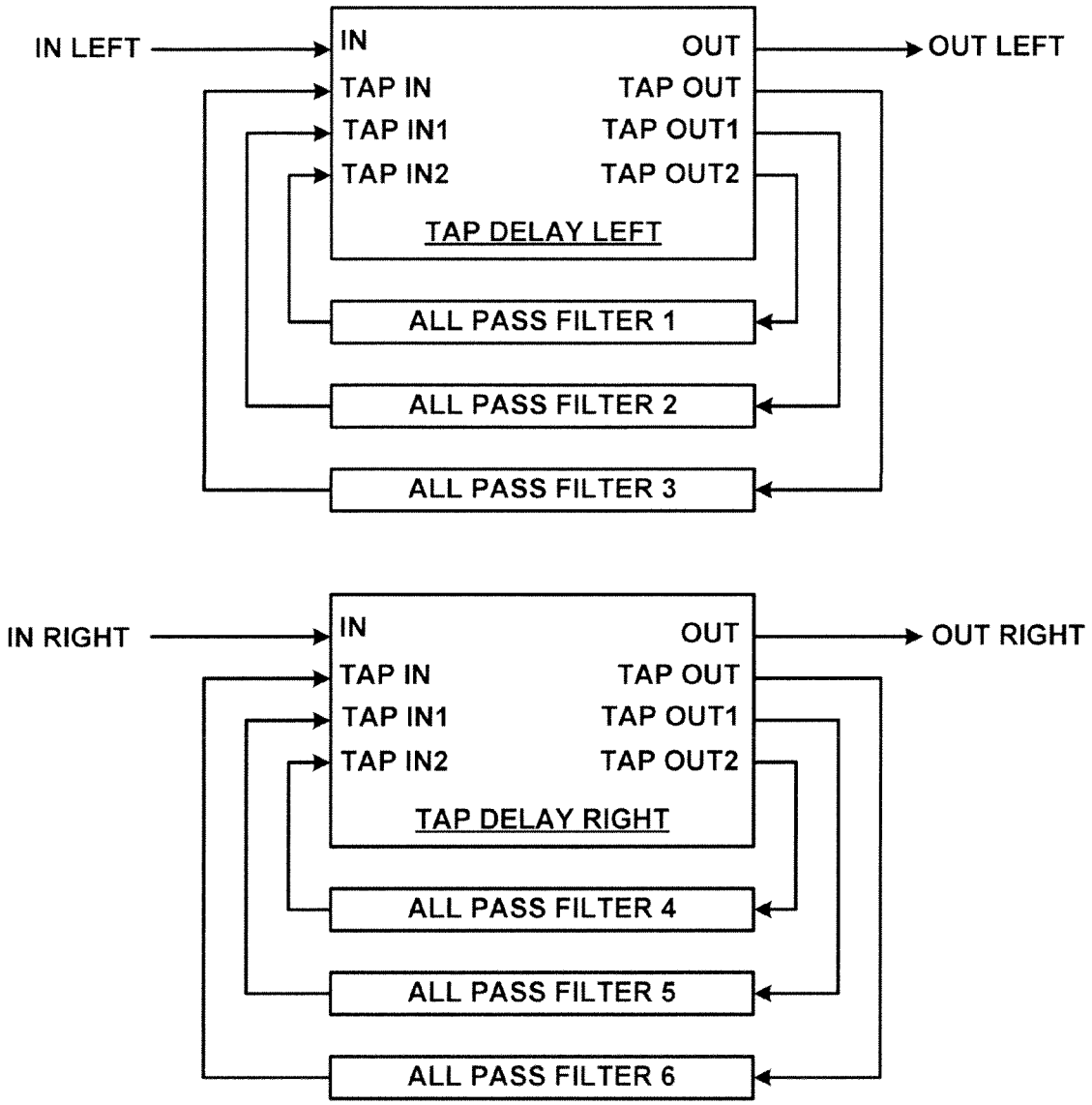
FIG. 3 is a diagram of a stereo reverberation generator in accordance with an exemplary embodiment of the present disclosure.

FIG. 3 is a diagram of a stereo reverberation generator in accordance with an exemplary embodiment of the present disclosure. The stereo reverberation generator is the second stage of system 100, and can be used to provide reverberation for the purpose of simulating room acoustics. Reverberation can be approximated by using a tapped delay all pass digital filter as shown. The nested architecture provides dense reflections. Left and right parameters are slightly different (gain and delay varies by 10% for example) to generate a stereo diffused acoustic effect.

Figure 6:
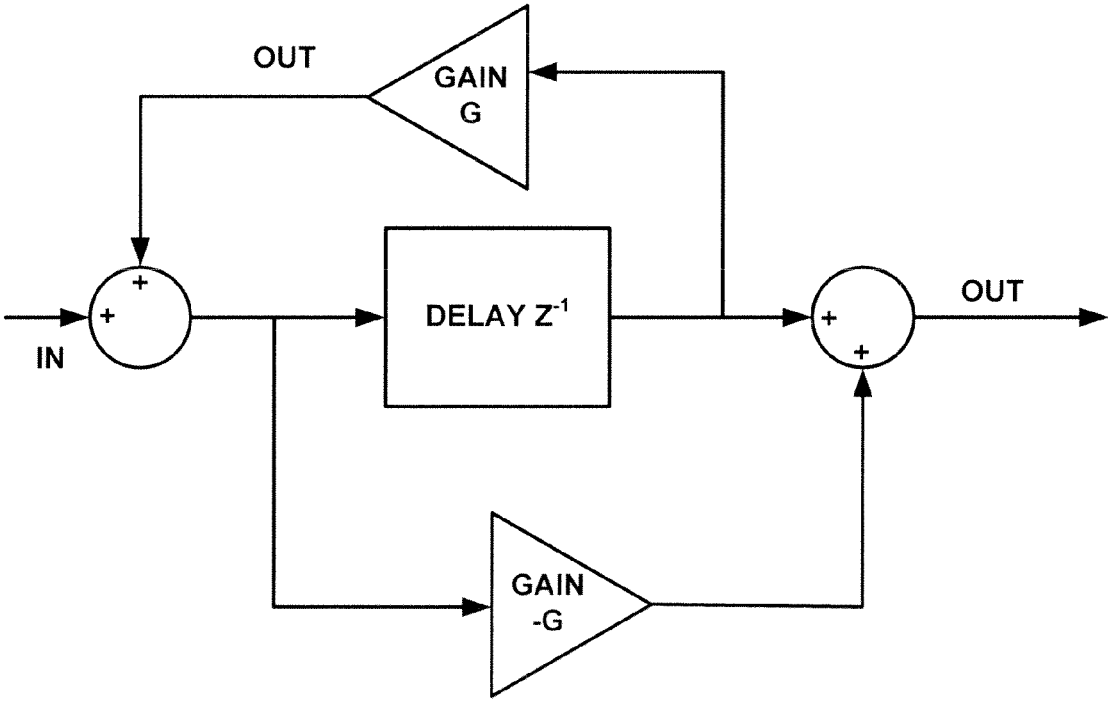
FIG. 6 is a diagram of an exemplary all-pass filter in accordance with an exemplary embodiment of the present disclosure.

FIG. 6 is a diagram of an exemplary all-pass filter in accordance with an exemplary embodiment of the present disclosure. The all-pass filter transfer function can be provided by:

$$H(z) = \frac{z^{-M} - g}{1 - gz^{-M}}$$

Figure 7:
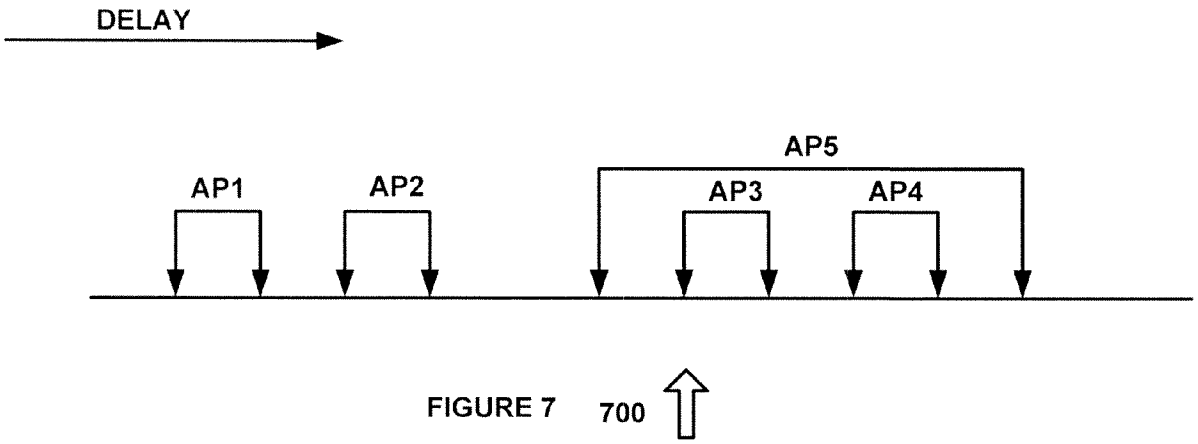
FIG. 7 is a diagram of an exemplary nested delay structure timeline.

In one exemplary embodiment, 5 stages of nested all-pass filters can be used to create reverb. An exemplary nested delay structure timeline is shown in FIG. 7.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for processing an audio signal for output to headphones comprising:

a room reflection emulation system configured to emulate sound reflections in a room and apply the emulated sound reflections to the audio signal;

a room acoustics emulation system configured to emulate acoustic properties of the room and apply the emulated acoustic properties to the audio signal, the room acoustic emulation system comprising a stereo reverberation generator; and a channel output configured to provide the audio signal with the applied emulated sound reflections and the applied emulated acoustic properties to the headphones;

wherein the room reflection emulation system further comprises a head shadow filter comprising a 1 tap IIR filter, the head shadow transfer filter receiving an input audio signal and generating an output, wherein the head shadow filter applies the transfer function $$H_{hs} = \frac{(\omega_0 + \alpha F_s) + (\omega_0 - \alpha F_s)Z^{-1}}{(\omega_0 + F_s) + (\omega_0 - F_s)Z^{-1}},$$

where $$\alpha = 1.05 + 0.95\ \cos\left(\frac{\Theta}{150^\circ} * 180^\circ\right),$$

$\Theta$=an azimuth angle of sound $\omega_0$=speed of sound/radius of head, and $F_s$=sampling rate.

2. The system of claim 1 wherein the room acoustics emulation system further comprises a plurality of nested all-pass filters having a nested delay structure timeline in accordance with FIG. 7.

3. The system of claim 1 wherein the room reflection emulation system further comprises a head delay filter comprising a first order all-pass digital filter, the head delay filter receiving the output of the head shadow filter as an input and generating an output by applying a head delay transfer function.

4. The system of claim 1 wherein the room reflection emulation system further comprises a shoulder reflection system comprising a digital tap delay, the shoulder reflection system receiving the input audio signal and generating an output; and wherein the room reflection emulation system further comprises a pinnae reflection system comprising a plurality of stages of digital tap delays, the pinnae reflection system receiving an output of an adder as an input and generating an output.

5. A system for processing an audio signal for output to headphones comprising:

a room reflection emulation system configured to emulate sound reflections in a room and apply the emulated sound reflections to the audio signal;

a room acoustics emulation system configured to emulate acoustic properties of the room and apply the emulated acoustic properties to the audio signal, the room acoustic emulation system comprising a stereo reverberation generator; and a channel output configured to provide the audio signal with the applied emulated sound reflections and the applied emulated acoustic properties to the headphones;

wherein the room reflection emulation system further comprises a head delay filter comprising a first order all-pass digital filter, the head delay filter receiving an output of a head shadow filter as an input and generating an output, wherein the head delay filter applies the transfer function $$\tau_h(\Theta) = \begin{cases} -\frac{\alpha}{c}\cos\Theta, & 0 \le \Theta < \frac{\pi}{2} \\ \frac{a}{c}\left(\Theta - \frac{\pi}{2}\right), & \frac{\pi}{2} \le \Theta < \pi \end{cases}$$

where $$a = \frac{1 - \tau_h}{1 + \tau_h}$$

$$H_{th} = \frac{a + z^{-1}}{1 + az^{-1}}.$$

6. The system of claim 5 wherein the room reflection emulation system further comprises an adder receiving an output of the head delay filter and a shoulder reflection system and generating an output.

7. The system of claim 5 wherein the room reflection emulation system further comprises a shoulder reflection system comprising a digital tap delay, the shoulder reflection system receiving the input audio signal and generating an output; and wherein the room reflection emulation system further comprises a pinnae reflection system comprising a plurality of stages of digital tap delays, the pinnae reflection system receiving an output of an adder as an input and generating an output.

8. A system for audio processing an audio signal for output to headphones comprising:

a room reflection emulation system configured to emulate sound reflections in a room and apply the emulated sound reflections to the audio signal;

a room acoustics emulation system configured to emulate acoustic properties of the room and apply the emulated acoustic properties to the audio signal, the room acoustic emulation system co a stereo reverberation generator; and a channel output configured to provide the audio signal with the applied emulated sound reflections and the applied emulated acoustic properties to the headphones;

wherein the room reflection emulation system further comprises a shoulder reflection system comprising a digital tap delay, the shoulder reflection system receiving the input audio signal and generating an output, wherein a time delay of the shoulder reflection system is generated in accordance with $$\tau_{SH}(\Theta) = 1.2\frac{180 - \Theta}{180}\left(1 - 0.00004\left((\phi - 80) * \frac{180}{180 + \phi}\right)^2\right.$$

and a gain of the shoulder reflection system is generated in accordance with:

$$g_{sh}=\cos(\Theta+90)*0.15.$$

9. The system of claim 8 wherein the room reflection emulation system further comprises a head shadow filter comprising a 1 tap IIR filter, the head shadow transfer filter receiving an input audio signal and generating an output by applying a head shadow transfer function; and a head delay filter comprising a first order all-pass digital filter, the head delay filter receiving the output of the head shadow filter as an input and generating an output by applying a head delay transfer function.

10. The system of claim 8 wherein the room reflection emulation system further comprises a pinnae reflection system comprising a plurality of stages of digital tap delays, the pinnae reflection system receiving an output of an adder as an input and generating an output.

11. A system for audio processing an audio signal for output to headphones comprising:

a room reflection emulation system configured to emulate sound reflections in a room and apply the emulated sound reflections to the audio signal;

a room acoustics emulation system configured to emulate acoustic properties of the room and apply the emulated acoustic properties to the audio signal, the room acoustic emulation system comprising a stereo reverberation generator; and a channel output configured to provide the audio signal with the applied emulated sound reflections and the applied emulated acoustic properties to the headphones;

wherein the room reflection emulation system further comprises a pinnae reflection system comprising five stages of digital tap delays, the pinnae reflection system receiving the output of an adder as an input and generating an output in accordance with $$A_n=\{1, 5, 5, 5, 5\},$$

$$B_n=\{2, 4, 7, 11, 13\},$$

$$D_n=\{1, 0.5, 0.5, 0.5, 0.5\},$$

where the delay is given by $$\tau_{pn} = A_n\cos\left(\frac{\Theta}{Z}\right)\sin(D_n(90-\phi)) + B_n,$$

where

Φ=elevation angle, and where a gain for the 5 stages is:

$$G=\{0.5, -0.4, 0.5, -0.25, 0.25\}.$$

12. The system of claim 11 wherein the room reflection emulation system further comprises a head shadow filter comprising a 1 tap IIR filter, the head shadow transfer filter receiving an input audio signal and generating an output by applying a head shadow transfer function; and a head delay filter comprising a first order all-pass digital filter, the head delay filter receiving the output of the head shadow filter as an input and generating an output by applying a head delay transfer function.

13. A system for audio processing comprising:

a room reflection emulation system for emulating sound reflections in a room, the room reflection emulation system further comprising:

a head shadow filter comprising a 1 tap IIR filter, the head shadow transfer filter receiving an input audio signal and generating an output, wherein the head shadow filter applies the transfer function $$H_{hs} = \frac{(\omega_0 + \alpha F_s) + (\omega_0 - \alpha F_s)z^{-1}}{(\omega_0 + F_s) + (\omega_0 - F_s)z^{-1}}$$

where $$\alpha = 1.05 + 0.95\cos\left(\frac{\Theta}{150^\circ} * 180^\circ\right),$$

Θ=an azimuth angle of sound

107 $_0$=speed of sound/radius of head, and $F_s$=sampling rate;

a head delay filter comprising a first order all-pass digital filter, the head delay filter receiving the output of the head shadow filter as an input and generating an output, wherein the head delay filter applies the transfer function $$\tau_h(\Theta) = \begin{cases} -\frac{\alpha}{c}\cos\Theta, & 0 \le \Theta < \frac{\pi}{2} \\ \frac{a}{c}\left(\Theta - \frac{\pi}{2}\right), & \frac{\pi}{2} \le \Theta < \pi \end{cases}$$

where $$a = \frac{1-\tau_h}{1+\tau_h}$$

$$H_{th} = \frac{a + z^{-1}}{1 + az^{-1}},$$

a shoulder reflection system comprising a digital tap delay, the shoulder reflection system receiving the input audio signal and generating an output, wherein a time delay of the shoulder reflection system is generated in accordance with $$\tau_{SH}(\Theta) = 1.2\frac{180-\Theta}{180}\left(1 - 0.00004\left((\phi - 80) * \frac{180}{180+\phi}\right)^2\right.$$

and a gain of the shoulder reflection system is generated in accordance with:

$$g_{sh}=\cos(\Theta+90)*0.15;$$

an adder receiving the output of the head delay filter and the shoulder reflection system and generating an output; and a pinnae reflection system comprising five stages of digital tap delays, the pinnae reflection system receiving the output of the adder as an input and generating an output in accordance with $$A_n=\{1, 5, 5, 5, 5\},$$

$$B_n=\{2, 4, 7, 11, 13\},$$

$$D_n=\{1, 0.5, 0.5, 0.5, 0.5\},$$

where the Delay is given by $$\tau_{pn} = A_n\cos\left(\frac{\Theta}{2}\right)\sin(D_n(90-\phi)) + B_n,$$

where

Φ=elevation angle, and where a gain for the 5 stages is:

$$G=\{0.5, -0.4, 0.5, -0.25, 0.25\}; \text{ and}$$

a room acoustics emulation system for emulating acoustic properties of the room, the room acoustics emulation system further comprising a plurality of nested all-pass filters having a nested delay structure timeline in accordance with FIG. 7.

14. A method for audio processing comprising:

receiving a left channel audio signal and a right channel audio signal;

applying head-related transfer function (HRTF) processing to the left channel audio signal and the right channel audio signal;

adding the HRTF-processed left channel audio signal to the HRTF-processed right channel audio signal to generate an HRTF-processed output; and applying stereo reverb processing to the HRTF-processed output to generate an audio output;

wherein applying HRTF processing to the left channel audio signal and the right channel audio signal comprises applying head shadow filter (HSF) processing to the left channel audio signal and the right channel audio signal to generate an HSF output; and wherein applying the HSF processing comprises applying a 1-tap infinite impulse response (IIR) filter that can be represented by:

$$H_{hs} = \frac{(\omega_0 + \alpha F_s) + (\omega_0 - \alpha F_s)Z^{-1}}{(\omega_0 + F_s) + (\omega_0 - F_s)Z^{-1}}$$

where $\omega_0$=speed of sound/radius of head, and $F_s$=sampling rate.

15. The method of claim 14 wherein applying HRTF processing to the left channel audio signal and the right channel audio signal comprises applying head delay filter (HDF) processing to the HSF output to generate an HDF output.

16. The method of claim 15 wherein the HDF processing comprises applying a first order all-pass digital filter.

17. The method of claim 14 wherein applying HRTF processing to the left channel audio signal and the right channel audio signal comprises applying shoulder reflection (SR) processing to the left channel audio signal and the right channel audio signal to generate an SR output.

18. The method of claim 17 wherein the SR processing comprises applying a digital tap delay in accordance with $$\tau_{SH}(\Theta) = 1.2\frac{180-\Theta}{180}\left(1 - 0.00004\left((\phi - 80) * \frac{180}{180+\phi}\right)^2\right.$$

where the gain g.sub.sh is defined as $$g_{sh}=\cos(\Theta+90)*0.15.$$

19. The method of claim 15 wherein applying HRTF processing to the left channel audio signal and the right channel audio signal comprises adding the HDF output and the SR output and performing pinnae reflection processing on the sum.

20. The method of claim 14, wherein applying HRTF processing to the left channel audio signal and the right channel audio signal comprises applying head delay filter (HDF) processing to the HSF output to generate an HDF output using a first order all-pass digital filter;

wherein applying HRTF processing to the left channel audio signal and the right channel audio signal comprises applying shoulder reflection (SR) processing to the left channel audio signal and the right channel audio signal to generate an SR output by applying a digital tap delay in accordance with $$\tau_{SH}(\Theta) = 1.2\frac{180-\Theta}{180}\left(1 - 0.00004((\phi - 80) * \frac{180}{180+\phi}\right)^2$$

where the gain g.sub.sh is defined as $$g_{sh}=\cos(\Theta+90)*0.15;$$

wherein applying HRTF processing to the left channel audio signal and the right channel audio signal comprises adding the HDF output and the SR output and performing pinnae reflection processing on the sum.

* * * * *